US009111470B2

(12) United States Patent
Anderson

(10) Patent No.: US 9,111,470 B2
(45) Date of Patent: Aug. 18, 2015

(54) RETRACTABLE ELECTROLUMINESCENT DISPLAY SYSTEM

(76) Inventor: Lori Anderson, Minnetonka, MN (US)

( * ) Notice: Subject to any disclaimer, the term of this patent is extended or adjusted under 35 U.S.C. 154(b) by 195 days.

(21) Appl. No.: 13/549,100

(22) Filed: Jul. 13, 2012

(65) Prior Publication Data

US 2013/0016497 A1 Jan. 17, 2013

Related U.S. Application Data

(60) Provisional application No. 61/507,499, filed on Jul. 13, 2011.

(51) Int. Cl.

| | |
|---|---|
| ***G09F 13/04*** | (2006.01) |
| ***F21V 19/02*** | (2006.01) |
| ***G09F 9/30*** | (2006.01) |
| ***G09F 13/22*** | (2006.01) |
| ***G09F 15/00*** | (2006.01) |

(52) U.S. Cl.

CPC ..... *G09F 13/04* (2013.01); *G09F 9/301* (2013.01); *G09F 13/22* (2013.01); *G09F 15/0062* (2013.01); *G09F 2013/225* (2013.01)

(58) Field of Classification Search

CPC ..... G09F 9/301; G09F 13/04; G09F 15/0062
See application file for complete search history.

(56) References Cited

U.S. PATENT DOCUMENTS

| | | | | |
|---|---|---|---|---|
| 5,120,618 | A | 6/1992 | Mori et al. | |
| 6,249,377 | B1 * | 6/2001 | Takamoto et al. | 359/461 |
| 6,630,783 | B1 | 10/2003 | Ono | |
| 6,643,966 | B2 * | 11/2003 | Schmitt | 40/610 |
| 6,771,232 | B2 * | 8/2004 | Fujieda et al. | 345/30 |
| 7,463,238 | B2 * | 12/2008 | Funkhouser et al. | 345/107 |
| 7,636,085 | B2 * | 12/2009 | Yang | 345/204 |
| 8,526,109 | B1 * | 9/2013 | Chen | 359/461 |
| 8,576,555 | B2 * | 11/2013 | Misawa | 361/679.27 |
| 2001/0018809 | A1 | 9/2001 | Heropoulos et al. | |
| 2002/0167500 | A1 * | 11/2002 | Gelbman | 345/204 |
| 2004/0183958 | A1 * | 9/2004 | Akiyama et al. | 349/58 |
| 2005/0040962 | A1 * | 2/2005 | Funkhouser et al. | 340/815.4 |
| 2007/0024551 | A1 * | 2/2007 | Gelbman | 345/85 |
| 2007/0180745 | A1 * | 8/2007 | Ofuji et al. | 40/601 |
| 2007/0241002 | A1 * | 10/2007 | Wu et al. | 206/150 |
| 2008/0086925 | A1 * | 4/2008 | Yang | 40/610 |
| 2008/0212271 | A1 * | 9/2008 | Misawa | 361/681 |
| 2009/0077846 | A1 | 3/2009 | Hill et al. | |
| 2010/0139135 | A1 * | 6/2010 | Taylor et al. | 40/541 |
| 2010/0182288 | A1 * | 7/2010 | Misawa | 345/204 |
| 2010/0188246 | A1 | 7/2010 | Getrost et al. | |
| 2011/0018785 | A1 * | 1/2011 | Aoki | 345/1.3 |
| 2011/0273826 | A1 * | 11/2011 | Misawa | 361/679.01 |
| 2012/0002357 | A1 * | 1/2012 | Auld et al. | 361/679.01 |
| 2013/0006188 | A1 * | 1/2013 | Pommereau et al. | 604/189 |

* cited by examiner

*Primary Examiner* — Elmito Breval
(74) *Attorney, Agent, or Firm* — Briggs and Morgan, P.A.

(57) ABSTRACT

A portable display system having a portable housing including a base for supporting the housing on a flat surface and including an electroluminescent display panel which is flexible and provided in a first extended orientation wherein the display panel is visible to a bystander and a second rolled orientation with the display panel returned into a housing interior. An elongated frame supports the display panel in the first extended orientation, with the frame including a first end which engages the housing and a second end that engages the display panel. A return mechanism, such as a spring return, is provided within the housing for retracting the display panel from the first extended orientation into the second retracted orientation.

6 Claims, 4 Drawing Sheets

RETRACTABLE ELECTROLUMINESCENT DISPLAY SYSTEM

RELATED APPLICATIONS

This application claims the benefit of U.S. Provisional Application Ser. No. 61/507,499, filed Jul. 13, 2011, and incorporated herein by reference.

FIELD OF THE INVENTION

The present disclosure relates generally to visual display systems, and more particularly, to a portable display system.

BACKGROUND OF THE INVENTION

Electroluminescent devices have provided illumination to a variety of products including display panels, board games, watch faces, and keyboards. Electroluminescent devices typically include a layer of phosphor-containing material disposed between two electrodes, at least one of the electrodes being light-transmissive.

Electroluminescent devices may be manufactured as discrete cells or as large panels, and may be formed on rigid or flexible substrates. Each component of the device may be formed as a separate layer, such as a foil sheet serving as an electrode, and a planar dielectric sheet, with the layers being laminated together via a heat and pressure process. Alternatively, the layers may be combined into overlapping coatings printed on a substrate, as is the case for a layer of light-transmissive conductive ink serving as a top electrode followed by a layer of phosphor ink in a dielectric matrix and then another conductive ink coating serving as a back electrode. Electroluminescent devices have found widespread uses, e.g. in signs, watch faces, and as back lighting for keyboards.

Electroluminescence technology has become increasingly important to enable homogeneous luminous surfaces free of shadow. Power consumption and structural thickness (of the order of magnitude of a millimeter or less) are desirably low. Typical uses include, apart from the background illumination of liquid crystal displays, the back-lighting of transparent films that are provided with lettering and/or image motifs. Thus, transparent electroluminescent arrangements, for example electroluminescent luminous boards based on glass or transparent plastics, which can serve for example as information carriers, advertising panels, or for decorative purposes, are known from the prior art.

SUMMARY OF THE INVENTION

It is to be understood that both the following summary disclosure and the detailed description are exemplary and explanatory and are intended to provide examples of the invention as claimed. Neither the summary disclosure nor the description that follows is intended to define or limit the scope of the invention to the particular features mentioned in the summary or in the description.

The invention provides a portable electroluminescent display system including a base unit for housing a flexible and retractable electroluminescent display panel. An elongated frame is provided to maintain a retracted electroluminescent display panel in an extended orientation during use. The support may include a plurality of posts. The posts can be quickly knocked-down and stored within the base unit to facilitate transport of the system. A power supply can also be incorporated into the base unit to provide power to the electroluminescent display panel.

One object of the invention is the provision of a portable display system providing a retractable electroluminescent display panel for use at trade shows, storefronts, booths, etc.

Another object of the invention is the provision of a portable display system housing for receiving an electroluminescent display panel rolled around a cylindrical tube. The cylindrical tube is rotatably supported within the housing to allow the electroluminescent display panel to be repeatedly extended and retracted during use. A return mechanism is provided to retract the electroluminescent display panel about the cylindrical tube prior to transport.

Another object of the invention is the provision of a portable display system providing protection against damage to a thin, relatively fragile electroluminescent display panel such as during transport between locations.

Other purposes will appear in the ensuing specification, drawings and claims. The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

According to one embodiment of the present invention, a retractable electroluminescent display panel comprises a design visible from at least one side of the panel.

Figure 1:
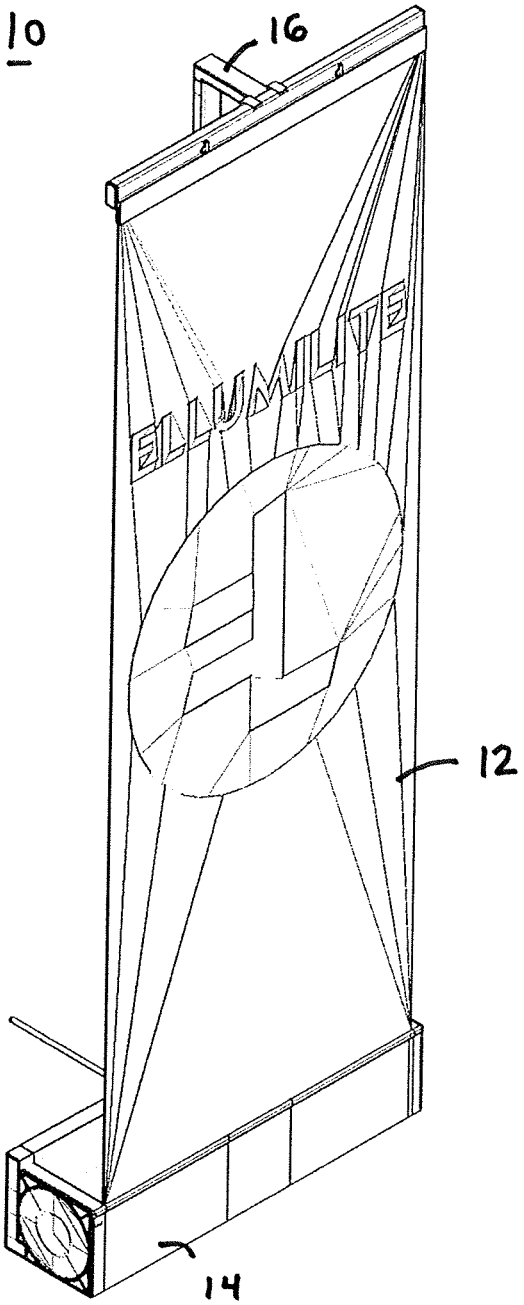
FIG. 1 is a perspective view of one embodiment of a display system of the present invention.
Figure 2:
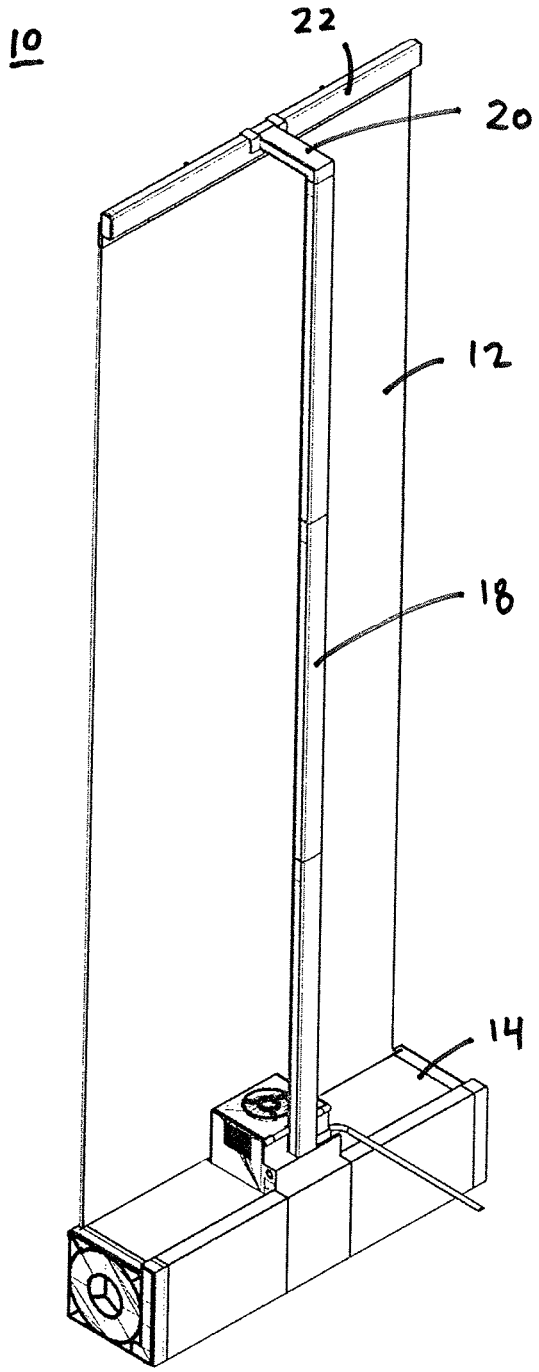
FIG. 2 is a perspective view of a back side of the display system of FIG. 1.

Referring to FIGS. 1 and 2, a display system 10 is illustrated to include a retractable electroluminescent display panel 12 extending from a base unit 14 and being temporarily secured to a frame 16. Briefly, electroluminescent display panel 12 includes a visual pattern being illuminated by an electroluminescent lamp. Further aspects of the electroluminescent display panel 12 will be described in further detail below. The base unit 14 includes a power supply 17 for powering the electroluminescent display panel.

During transport of the display system 10, the electroluminescent display panel is retracted into the base unit 14. The electroluminescent display panel 12 may be maintained upon a cylindrical roll, similar to a retractable window covering, or may be provided in other configurations, such as fan-fold, etc. The base unit 14 provides protection against damage to the electroluminescent display panel 12 during transport. The base further includes an extension/retraction mechanism for permitting the electroluminescent display panel to be withdrawn from the base unit 14. A variety of spring retraction mechanisms could be used to retain the electroluminescent display panel within the base unit 14.

Figure 3:
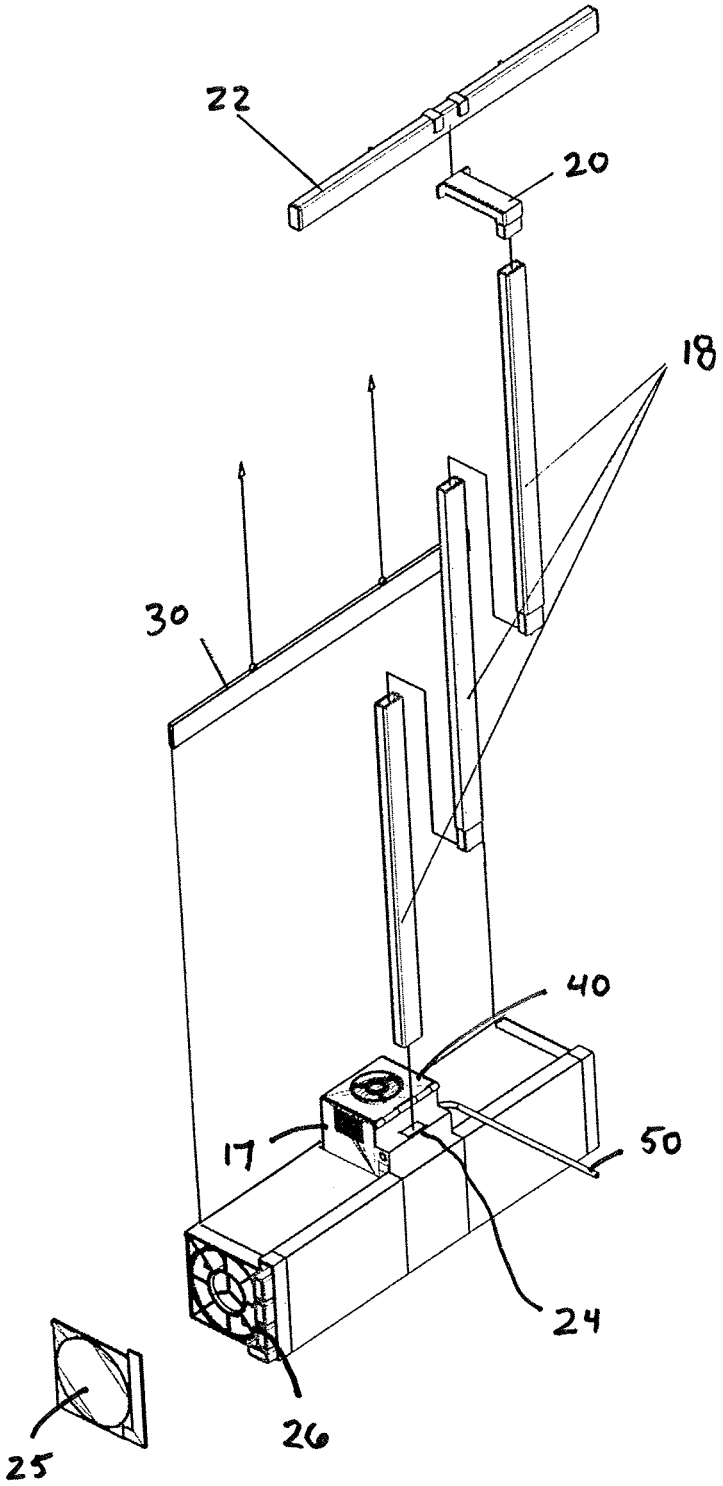
FIG. 3 is a perspective view of the display system of FIG. 1 showing partial disassembly of the system.

Referring to FIG. 3, the frame 16 includes a plurality of posts 18, an extended bracket 20 and a top bracket 22. An end of the lower post 18 is adapted to be received into the base unit 14 at aperture 24. The posts 18 are designed to be easily set-up and taken-down to facilitate transport of the display system 10 between locations. A removable side panel 25 is provided upon the housing 14. With the side panel 25 moved, storage compartment 26 is exposed. The side panel 25 may be hinged to or separable from the base unit 14.

Figure 4:
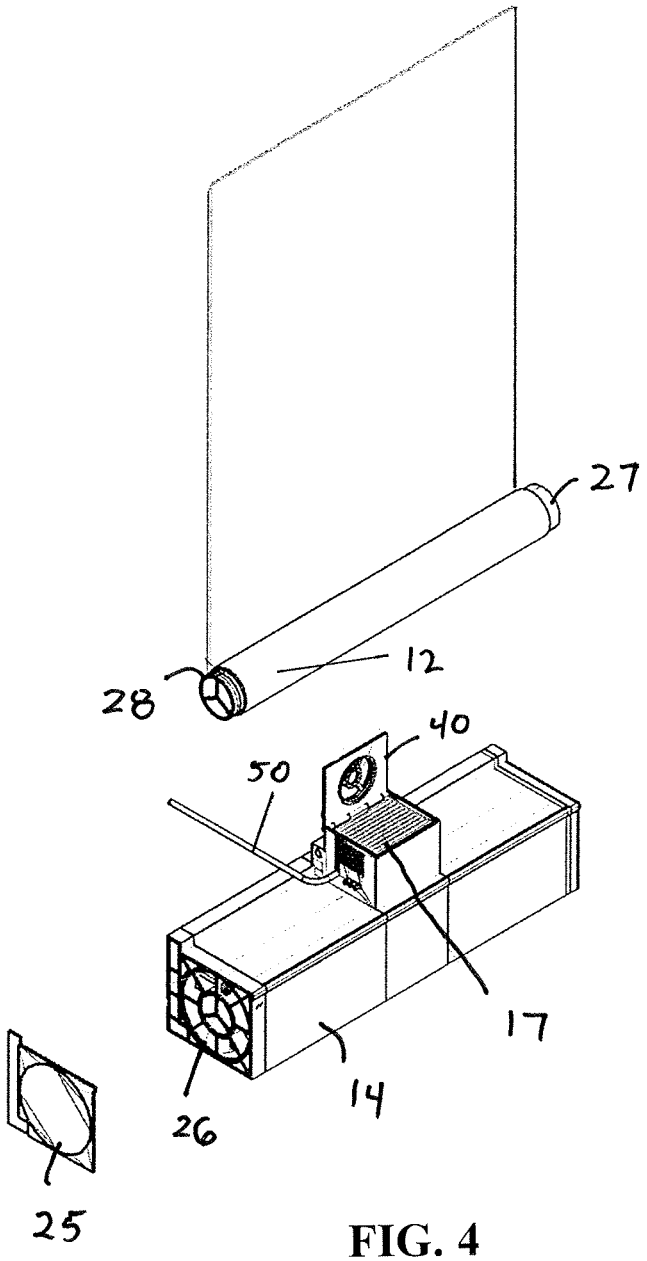
FIG. 4 is a perspective view of the display system of FIG. 1 showing further disassembly of the system.

Referring to FIG. 4, the cylindrical tube 27 is shown, about which the display panel 12 is wrapped when retracted into housing 14. One or more copper rings 28, such as slip rings, may be provided on the tube 27 to provide electrical communication between the power supply 17 and the display panel 12.

Posts 18 are shown as three separate elements having interconnecting structures at each end to facilitate assembly. In alternative embodiments, a single telescoping post or other post-type supports could be used to maintain the electroluminescent display panel 12 in an extended display orientation. Posts 18 are sized to be received into the storage compartment 26 of the base unit 14.

The top bracket 22 is designed to engage a pulling bar 30 attached to an end of the retractable electroluminescent display panel 12. The pulling bar 30 can be secured to the top bracket 22 via a hook, clamps, or hook and loop fabric fasteners, for example.

Base unit 14 is shown with a generally rectangular form with a lower surface being generally flat and adapted to support the display system 10 on a floor surface, countertop or other flat surfaces. In other embodiments, legs (not shown) may support the base unit 14 off the floor or other flat surface In addition to the power supply for the electroluminescent display panel 12, the base unit 14 includes a cooling fan 40 for power supply cooling.

The power supply 17 and cooling fan 40 can be operated on AC and/or DC power. In the embodiment illustrated in the figures, a power cord 50 is intended to be connected to an AC wall outlet, etc. In other embodiments, batteries (not shown) may be used to power the electroluminescent display panel 12.

Further aspects of the electroluminescent display panel 12 will now be described. The electroluminescent display panel 12 may include a display panel separable from an electroluminescent light panel or the electroluminescent display panel could include a single panel incorporating both the display panel and the electroluminescent light panel.

The electroluminescent display panel can be manufactured with an ink system to define a pattern. The electroluminescent ink system may comprise three printed layers which are superimposed within the print pattern, including: (i) an electroluminescent ink layer (commonly known as a "phosphor" layer), which is directly applied to the conductive-coated surface of the light permeable material, (ii) a dielectric (electrically insulating) ink layer, and (iii) a print pattern conductive ink layer (commonly known as a "backplate" layer), typically a conductive silver ink that is printed over the dielectric ink layer.

In one example, the flexible display panel may include a sheet of light permeable material having two sides, one side facing said one side of said panel and the other side facing said other side of said panel, said sheet comprising a light permeable electrically conductive coating over the whole area of the other side of the sheet, a print pattern applied to the electrically conductive coating which subdivides the panel into printed portions and unprinted portions, the print pattern comprising an electroluminescent ink system comprising a printed electroluminescent ink layer, a printed dielectric ink insulating layer and a print pattern conductive ink layer, wherein the design is superimposed on or forms part of the print pattern, and wherein the design comprises a transparent or translucent design layer, and wherein the conductive coating and the print pattern conductive ink layer are connected to an electrical power supply, and wherein the electroluminescent ink layer is capable of being illuminated by means of electric current through the conductive coating and the print pattern conductive ink layer, and wherein illumination of the electroluminescent layer illuminates the design.

A first conductive busbar is printed or otherwise adapted to connect to elements of the print pattern conductive ink layer, typically a printed pattern of lines. The elements of the print pattern are defined by the conductive ink layer. These elements are connected to a single, first connector and thereby to the power supply. A second conductive busbar is printed or otherwise applied in a way that electrically insulates it from both the first busbar and the print pattern conductive ink layer and connects the uniform conductive ink layer to a second connector and thereby to the power supply 17. This is typically done by a printed second conductive busbar which surrounds and is spaced from the printed pattern. The busbars and portions of the electrical connectors typically comprise silver inks. The busbars and electrical connectors can be located within the base unit 14 to protect against inadvertent contact.

Optionally, the first and/or the second conductive busbars are overprinted with the dark opaque mask layer, typically black, to provide a consistent visible impression from the other side of the panel.

When electric currents of appropriate voltage and frequency are applied to the print pattern conductive ink layer and the uniform conductive coating, the intermediate layer of electroluminescent ink (or phosphor) emits light. The light is transmitted through the uniform conductive coating and its transparent carrier film or sheet material. This whole assembly is known as an "EL lamp". Additional details of electroluminescent lamp technology are disclosed in U.S. Pat. Nos. 5,120,618 and 6,630,783, both incorporated herein by reference.

The electroluminescent ink system, for example of phosphors, dielectric and conductive silver inks, may be solvent based.

In one example of the electroluminescent display panel 12, in order to both protect the printed electroluminescent ink system and electrically insulate all the conductive surfaces, the printed side of the electroluminescent lamp may be overlaminated with a transparent, electrically insulating film incorporating a clear adhesive. Alternatively or additionally, the unlaminated or the overlaminated, electrically conductive side of the electroluminescent lamp may be affixed to a non-transparent backing sheet that provides both electrical insulation and support for the whole construction.

In one embodiment of the invention the design image on the electroluminescent display panel 12 is optionally printed in register with the print pattern of the electroluminescent lamp using suitable solvent-based or UV-curing translucent graphic inks, onto the one, uncoated side of the light permeable material. Alternatively, the design image is printed, using suitable aqueous, solvent-based or UV-curing translucent graphic inks, onto a suitable another sheet of light permeable material, for example a transparent self-adhesive film, for example self-adhesive polyester film, which is applied to the one, uncoated side of the light permeable material.

Alternatively, the design is in the form of a self-adhesive film, for example self-adhesive vinyl film, cut in the form of the print pattern and applied to the one, uncoated side of the light permeable material, in registration with the print pattern of the electroluminescent lamp. Alternatively, any of the above methods are used to apply the design image to another sheet of light permeable material, typically transparent, that is subsequently placed adjacent to and preferably in contact with the electroluminescent lamp, in such a way as to place the design image in register with the print pattern of the electroluminescent lamp. The use of a separate design panel with a design layer, that is placed in front of and preferably in direct contact with the one side of the electroluminescent lamp but which is not an integral part of the lamp itself, facilitates the changing of the design image while leaving the electroluminescent lamp itself unaffected. Such an arrangement is particularly beneficial if the design is to be regularly changed, for example to advertise different products or services in a shop window, trade show, presentation, etc.

The design image is optionally printed in register with the print pattern of the electroluminescent lamp using suitable solvent-based or UV-curing translucent graphic inks, onto the one, uncoated side of the light permeable material. Alternatively, the design image is printed, using suitable aqueous, solvent-based or UV-curing translucent graphic inks, onto a suitable another sheet of light permeable material, for example a transparent self-adhesive film, for example self-adhesive polyester film, which is applied to the one, uncoated side of the light permeable material.

Power to the electroluminescent display panel 12 is controlled manually or by means of a control system. A control system can be automatically activated by any one of several means, for example a timing device to illuminate the panel at pre-determined intervals, or a light-sensing device to illuminate the panel during times of low ambient lighting (for example after dark), or a movement-sensing device to illuminate the panel when someone walks past or up to the panel, or any combination of these devices. For example, a panel of the invention affixed to a display stand is advantageously activated by a proximity sensor. The attention of a person approaching the display is thus automatically attracted to the electroluminescent sign.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A display system comprising:

a portable housing adapted to be carried by a person between geographically separated locations, said housing including a lower base surface for supporting the housing on a ground surface and an upper surface having an aperture positioned at a rear side of the housing and a display opening positioned at a front side of the housing, the display opening being a slot extending across the front side of the housing, with the lower base surface being generally rectangular and with no other ground-engaging lateral supports, and said housing including an interior storage compartment;

an electroluminescent display panel comprising an electroluminescent ink layer, a dielectric ink layer and a backplate layer, said display panel being flexible and capable of being provided in a first extended orientation wherein the display panel is visible to a bystander and a second refracted orientation wherein the display panel is returned into the housing;

a power supply within the housing and adapted to power the display panel;

a pair of conductive leads within the housing and coupled between the power supply and the display panel;

a cylindrical tube about which the display panel is wound during storage;

at least one conductive slip ring assembly positioned at an end of the cylindrical tube;

at least one busbar defined upon a surface of the display panel and being coupled to one of the pair of conductive leads via said at least one conductive slip ring assembly;

an elongated frame for supporting the display panel in the first extended orientation relative to the housing, said frame including a first end which is inserted into the aperture in the upper surface of the housing and a second end that engages a upper bracket that supports a pulling bar and an end of the display panel, with frame extending vertically from the housing and the upper bracket extending horizontally from the second end of the frame and with a cooling fan being positioned between the frame and the display panel in the first extended orientation, wherein the base surface of the housing supports the frame and display panel in the first extended orientation without the frame being in contact with the ground surface, and wherein the frame includes a plurality of posts, and wherein the upper bracket, pulling bar and plurality of posts are carried within the interior storage compartment of the housing when not in use to support the display panel; and a return mechanism within the housing for retracting the display panel from the first extended orientation into the second retracted orientation.

2. The display system of claim 1 wherein the display panel is adapted to be rolled into a cylindrical form when in its second retracted orientation and wherein the frame extends vertically from the housing and with the frame and the display panel being generally parallel with a power supply and cooling fan being centrally positioned between ends of the housing.

3. The display system of claim 1 wherein the return mechanism includes a spring device for rotating the tube and retracting the display panel back into the housing prior to transport of the system.

4. A display system comprising:

a portable housing including a base surface for supporting the housing on a flat surface and an upper surface having an aperture, with the housing including an interior storage compartment;

an electroluminescent display panel comprising an electroluminescent ink layer, a dielectric ink layer and a backplate layer, said display panel being flexible and capable of being provided in a first extended orientation wherein the display panel is visible to a bystander and a second rolled orientation with the display panel returned into a housing interior and wound around a cylindrical tube;

a power supply within the housing and adapted to power the display panel;

a cooling fan within the housing;

a pair of conductive leads within the housing and coupled between the power supply and the display panel;

at least one busbar defined upon one or more surfaces of the display panel, said at least one busbar being coupled to one of the pair of conductive leads via at least one slip ring positioned at an end of the cylindrical tube, with said at least one slip ring being positioned away from an edge of the wound display panel;

an elongated frame for supporting the display panel in the first extended orientation, said frame including a first end which is inserted into the aperture in the upper surface of the housing and a second end that engages a upper bracket that supports a pulling bar and an end of the display panel, wherein a cooling fan is positioned between the frame and the display panel when the display panel is in the first extended orientation, wherein the base surface of the housing supports the frame and display panel in the first extended orientation without the frame being in contact with the flat surface, and wherein the frame includes a plurality of posts, and with the upper bracket, pulling bar, and plurality of posts being carried within the interior storage compartment of the housing when not in use; and a return mechanism within the housing for retracting the display panel from the first extended orientation into the second retracted orientation.

5. The display system of claim 4 wherein the return mechanism includes a spring device for rotating the tube and retracting the display panel back into the housing prior to transport of the system.

6. A display system comprising:

a housing adapted to be supported upon a floor surface, said housing including a generally rectangular lower base surface for supporting the housing on the floor surface and an upper surface having an aperture, with said housing including an interior storage compartment;

a flexible light emitting display panel adapted to be rolled about a tube within the housing and into a cylindrical form, said display panel including a fluorescent layer for emitting light, a high-conductive, non-transparent electrode formed on one major surface of said fluorescent layer and a low-conductive transparent electrode formed on the other major surface of said fluorescent layer;

a power supply system including a first power supply lead connected to said high conductive non-transparent electrode, a high conductive power feeding layer formed on an associated part of said low conductive transparent electrode and a second power supply lead connected to said high conductive power feeding layer;

a pair of conductive leads within the housing and coupled between the power supply and the display panel;

at least one busbar located within the housing and defined upon one or more surfaces of the display panel, said at least one busbar being coupled to one of the pair of conductive leads via at least one conductive slip ring positioned at an end of the cylindrical tube;

an extendable frame for supporting the display panel between a first end of the frame and the housing so as to expose the display panel, said frame including a plurality of posts with one post end being inserted into the aperture in the upper surface of the housing, said frame also including an upper bracket and a pulling bar, wherein the base surface of the housing supports the frame and display panel in an upright manner with the display panel being extended and supported at one end by the pulling bar and bracket, and with a cooling fan being centrally positioned between ends of the housing and between the frame and the display panel when the display panel is extended, and with no portion of the frame otherwise engaging the floor surface to support the display panel when so extended, and wherein the plurality of posts and upper bracket and pulling bar are separated from the display panel when not in use and are stored within the interior storage compartment of the housing; and a spring mechanism connected to the housing for biasing the display panel into said cylindrical form within the housing when the display panel is released from the first end of said extendable frame, wherein the display panel is provided in the cylindrical form about the tube when contained within the housing, and wherein the extendable frame is carried upon the housing when the light emitting panel is retracted into the housing.

* * * * *